United States Patent [19]

Eber et al.

[11] Patent Number: 4,884,590

[45] Date of Patent: Dec. 5, 1989

[54] ELECTRIC MOTOR DRIVEN AIR VALVE

[75] Inventors: David H. Eber, La Crosse, Wis.; H. Kenneth Ring, Houston, Minn.

[73] Assignee: American Standard Inc., New York, N.Y.

[21] Appl. No.: 279,638

[22] Filed: Dec. 5, 1988

[51] Int. Cl.[4] ..... F16K 31/04

[52] U.S. Cl. ..... 137/1; 137/554; 137/219; 251/129.11; 251/129.12

[58] Field of Search ..... 251/129.11, 129.12; 137/219, 554

[56] References Cited

U.S. PATENT DOCUMENTS

| | | | |
|---|---|---|---|
| 1,974,335 | 9/1934 | Kimball | 137/139 |
| 2,598,062 | 5/1952 | Krecan | 137/724 |
| 2,821,343 | 1/1958 | Payne | 236/13 |
| 3,071,149 | 1/1963 | Rhodes | 137/243.3 |
| 3,616,884 | 11/1971 | Balz | 192/141 |
| 3,974,859 | 8/1976 | McNabney | 137/625.37 |
| 4,082,114 | 4/1978 | Hantke et al. | 136/625.37 |
| 4,177,970 | 12/1979 | Ring, Jr. | 251/61.3 |
| 4,305,418 | 12/1981 | Jensen et al. | 137/219 |
| 4,500,036 | 2/1985 | Vollmer | 236/68 |
| 4,775,133 | 10/1988 | Ring et al. | 251/129.12 |
| 4,780,785 | 10/1988 | Schabert et al. | 251/129.13 |

*Primary Examiner*—Arnold Rosenthal

*Attorney, Agent, or Firm*—William J. Beres; Robert J. Harter

[57] ABSTRACT

An air valve actuated by an electric motor has a cylindrical inlet section. The inlet section defines a seating surface upstream of which is a support grid. A backplate, upon which the actuating motor is mounted, is fixedly supported by a plurality of rods that extend downstream of the inlet section. A damper assembly includes a generally planar damper mounted for movement axially of the inlet section. The damper assembly includes a splined rod which extends upstream and into a cooperating spline in the support grid. A threaded spindle extends downstream of the damper plate through a cooperatively threaded motor-driven drive gear which is mounted for rotation on the backplate. Because a portion of the damper assembly is splined, the damper assembly cannot rotate and is driven axially within the valve by the rotation of the drive motor and drive gear. A strain sensing device is mounted on the valve such that the abutment of the damper with the inlet section seating surface, which causes a detectable strain to develop within the valve, is sensed immediately upon its occurrence. The strain signal from the sensor is used to control the de-energization of the motor so that the stalling of the motor as a result of its driving the damper into abutment with the inlet section seating surface is prevented while the development of a tight seal between the damper and its seating surface is assured.

15 Claims, 4 Drawing Sheets

ELECTRIC MOTOR DRIVEN AIR VALVE

BACKGROUND OF THE INVENTION

The present invention is related to U.S. Pat. No. 4,775,133 assigned to the assignee of the present invention.

The present invention relates to an electrically actuated air valve for use in an air distribution system wherein the volume of conditioned air supplied to a zone is varied in order to control the temperature within the zone.

One of the currently most favored types of building ventilation systems is the variable air volume system wherein a central source provides conditioned air for distribution to various zones within a building via a network of ducts. Since heating and cooling requirements vary from zone to zone, and within individual zones depending upon factors such as solar load and the nature of zone usage, it is necessary that provision be made to selectively control the amount of conditioned air supplied to a zone in response to local demand.

In a variable air volume system, the selective delivery of conditioned air to a particular zone is accomplished through the association of at least one air distribution box with each zone. Such air distribution boxes define supply plenums and include one or more air outlets in communication with the zone. Additionally, each box has an airflow control valve, for varying the volume of air delivered into the plenum and, therefore, into the zone. Such air valves are controlled by a thermostat in the zone so as to supply the proper volume of conditioned air to maintain or achieve a selected zone temperature.

The present invention is directed to an electric motor driven air valve for use in variable air volume air distribution systems. The most common type of electrically driven air valve is that shown and taught in U.S. Pat. No. 4,082,114, to Hantke et al., which is assigned to the assignee of the present invention. The valve of the Hantke patent includes a closed ended cylindrical portion downstream of the valve inlet in which a generally tubular valve member is disposed for movement axially of the valve housing. The size of a series of radial ports, and therefore the flow of air through the valve, is determined by the position of the valve member within the cylindrical, closed ended valve housing.

The valve of the Hantke design is relatively complex and is, as well, somewhat expensive of manufacture. Additionally, dedicated sealing means are required at each peripheral edge of the tubular valve member in order to completely shutoff airflow through the valve. Although not detailed in the Hantke patent, the de-energization of the valve motor is based upon the physical contact of a portion of the damper assembly, subsequent to the movement of a portion of the assembly into contact with a limit switch.

U.S. Pat. No. 4,775,133 referred to above, discloses an electric motor driven air valve having a physically movable, spring biased backplate. In response to the abutment of the valve damper with a fixed inlet seating surface the backplate of the valve of the aforementioned application is driven away from the valve inlet until such time as contact with a limit switch is made which de-energizes the motor. The motor continues to drive the valve damper into the seating surface even after the initial abutment of the valve damper with its seat, until the limit switch is made.

The arrangement of the aforementioned patent succeeds in the prevention of motor stalling subsequent to the abutment of the valve damper and inlet seating surface but is successful at the cost of having to provide for the physical movement and biasing of the valve backplate. The arrangement contemplates the spring loading of the backplate and the provision of limit switches to control motor operation. It will be appreciated that variations among mechanical components and in the assembly/manufacturing process as well as damage to the relatively delicate limit switches can affect the reliability of the valve when such switches are employed.

The need continues to exist for an electric motor driven air valve which is relatively uncomplicated and inexpensive of manufacture yet which provides for the precise control of the volume of air flowing through the valve and is capable of tight, controlled closure in a manner not susceptible to mechanical binding and/or motor stalling.

The present invention is therefore directed generally to an electric motor driven air valve which is commercially practicable and which employs the development of strain in a valve component, subsequent to valve closure, to control the energization and de-energization of the drive motor.

SUMMARY OF THE INVENTION

It is an object of the present invention to provide an air valve assembly which includes integral actuator means so as to eliminate the need to separately mount the actuator portion of the valve.

It is another object of the present invention to provide an electric motor driven air valve assembly wherein the valve actuating mechanism is sheltered and disposed downstream of both the valve inlet and valve damper plate so as to achieve the quiet, controlled flow of air through the valve.

It is another object of the present invention to provide a motor driven air valve which employs no levers, blades or linkages.

It is still another object of the present invention to provide a motor driven air valve having an inlet section which is configured for mounting to an air distribution box in a manner which supports the entire structure and weight of the valve and which allows for the efficient mounting of the valve to the box as well as the removal of the valve therefrom to allow for quick replacement.

It is a further object of the present invention to provide an electric motor driven air valve in which the de-energization of the drive motor, subsequent to its having driven the valve damper into abutment with a valve seating surface, is in response to the development of strain in the valve which occurs at detactable levels immediately subsequent to such abutment.

These and other objects of the present invention, which will become apparent when the following Description of the Preferred Embodiment and attached drawing figures are simultaneously considered, are accomplished by an electric motor driven air valve having a unitary inlet section which defines a seating surface and has a spider-like support grid in its upstream portion. A backplate is disposed downstream of and is fixedly supported by the inlet section. For purposes of this patent, upstream will refer to the direction from which air is supplied to the valve while downstream will refer to the direction of airflow through the valve as is indicated by the arrows in the drawing figures.

The electric motor driven air valve of the present invention includes a unitary damper assembly which is comprised of a generally flat damper plate having a formed peripheral seating surface. The damper assembly has a splined shaft extending upstream of the damper plate and a threaded spindle extending downstream therefrom. The damper plate is mounted for movement between the backplate and the inlet section of the valve.

The splined shaft extending upstream of the damper plate is slideably engaged in a cooperating splined bushing disposed in the inlet section support grid. The threaded spindle extending downstream of the damper plate is supported in a cooperatively threaded drive gear mounted for rotation on the backplate.

An electric motor is mounted on the backplate and drives the drive gear through a pinion. Because the damper assembly is splined on its upstream end and is thereby prevented from rotating and because the threaded downstream extending spindle is threadably engaged in the rotatably mounted drive gear, the rotation of the drive gear causes the damper assembly to be driven axially of the valve inlet section in accordance with the direction of motor rotation.

The motor, which is a reversible motor, drives the damper assembly into contact with the inlet section seating surface so as to close off airflow through the valve. The backplate, on which the drive motor is located, is fixedly mounted to the inlet section so that a detectable strain builds within the valve immediately subsequent to the abutment of the damper assembly with the inlet section seating surface. A strain sensing device senses the strain as it develops in the valve. The sensing of such strain is employed to de-energize the motor before the strain develops to a degree which might potentially bind valve components and cause the motor to stall when it is ordered to re-open the valve by operating in the reverse direction.

DESCRIPTION OF THE PREFERRED EMBODIMENT

Figure 1:
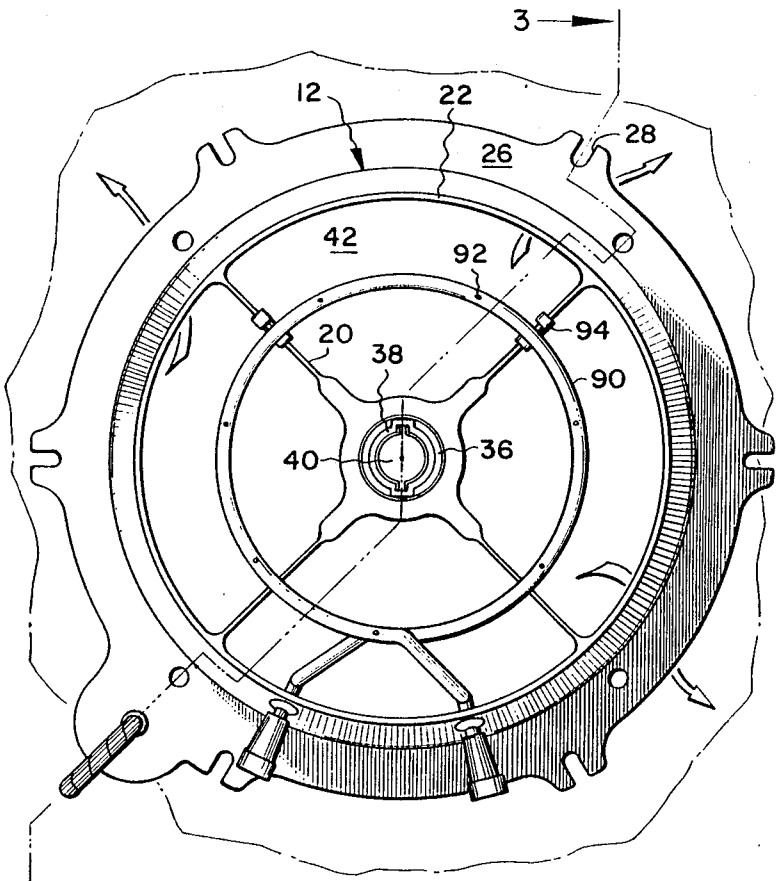
FIG. 1 is an end view of the air valve of the present invention when viewed from upstream of the valve.

Referring concurrently to FIGS. 1 through 4, air valve 10 is comprised of three primary sections, a preferably die cast inlet section 12, backplate 14 and damper assembly 16. Backplate 14 is fixedly attached to and supported by inlet section 12 through a plurality of rods 18 which extend downstream of the inlet section. The air passage defined by die case inlet section 12 is venturi-like in nature and provides for relatively low static pressure requirements in the system in which valve 10 is employed. Damper assembly 16, as will further be discussed, is supported for slideable movement axially of the longitudinal axis of inlet portion 12 by both backplate 14 and a spider-like support grid 20 in inlet section 12.

Figure 3:
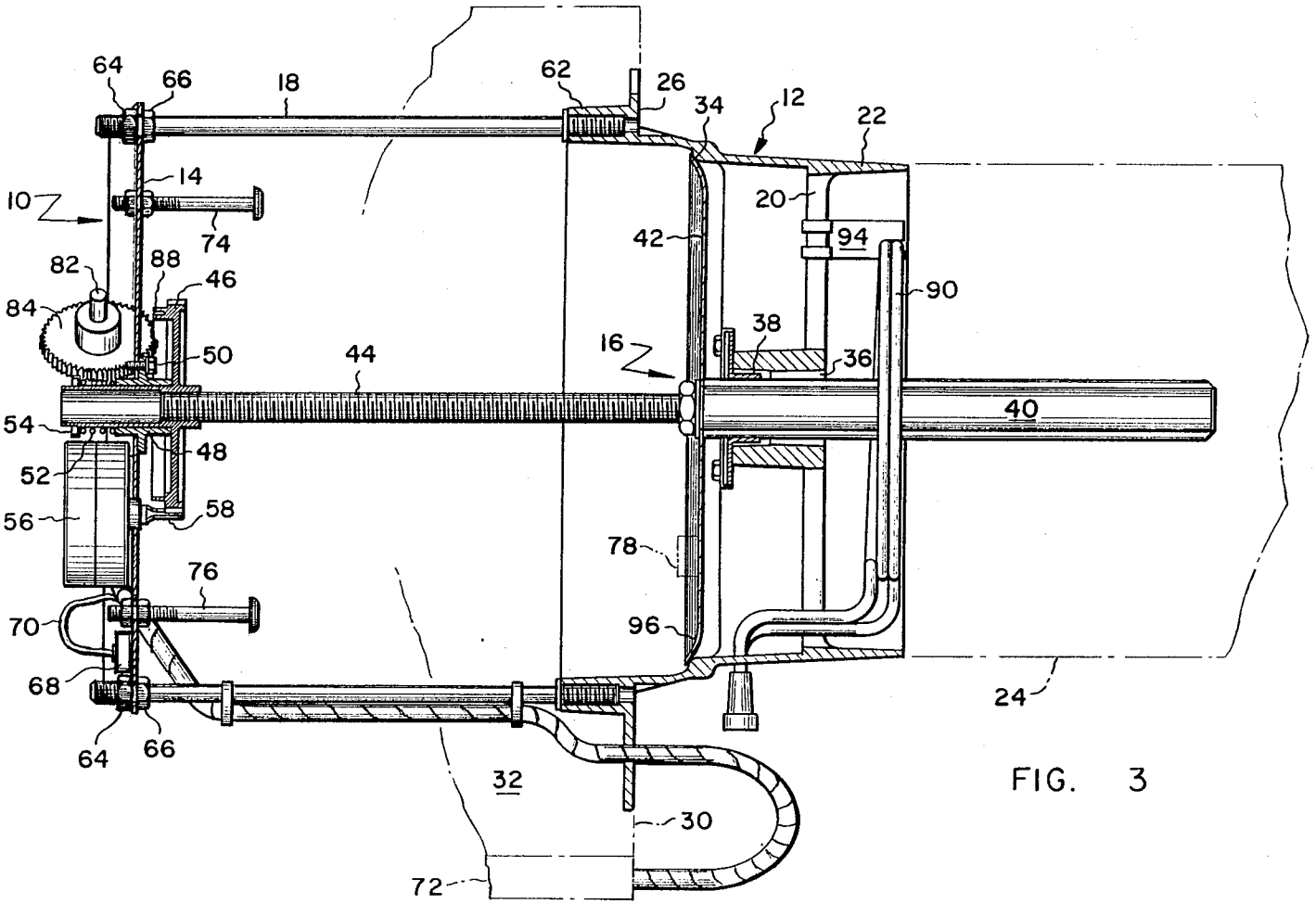
FIG. 3 is a cross-sectional view taken along lines 3—3 of FIG. 1 illustrating the air valve of the present invention in the fully closed position.
Figure 4:
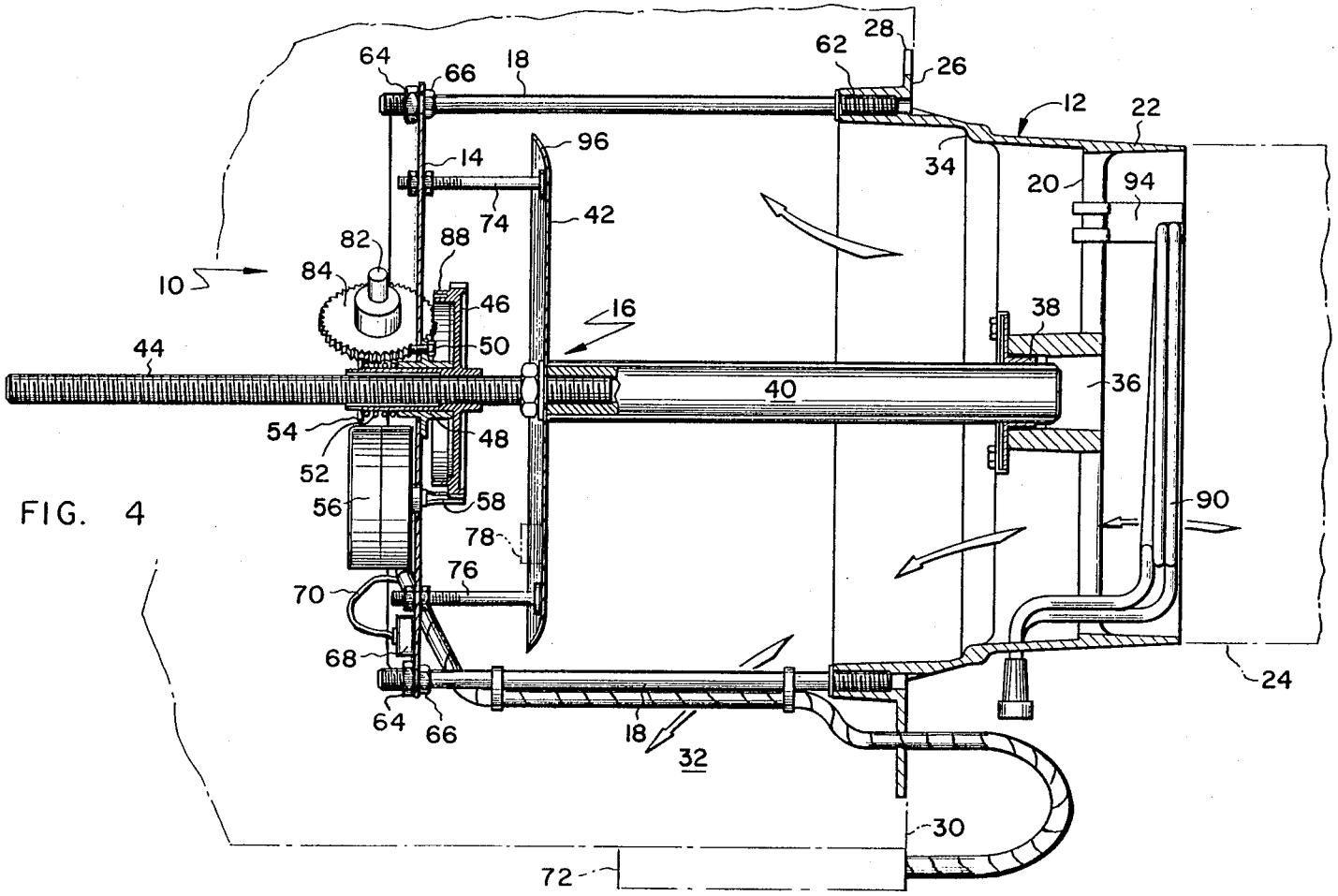
FIG. 4 is a cross-sectional view taken along lines 3—3 of FIG. 1 illustrating the valve of the present invention in the fully open position.

Inlet section 12 of valve 10 has a surface 22 which is configured for engagement with a building air supply duct 24, illustrated in phantom in FIGS. 3 and 4. Inlet section 12 also has a radially extending flange 26 from which a series of lugs 28 extend so as to permit the attachment and mounting of valve 10, by means of sheet metal screws (not shown), to an air distribution box 30. The air distribution box, shown in phantom in FIGS. 3 and 4, defines a plenum 32 the flow of air into which is controlled in accordance with the position of damper assembly 16 in air valve 10.

Inlet section 12 defines a generally annular seating surface 34 in its interior and includes the aforementioned support grid 20 which defines an aperture 36 in which a splined bushing 38 is retained.

A cooperatively splined shaft 40 is captured for slideable movement through bushing 38. By virtue of the spline fit of shaft 40 in bushing 38, the rotation of splined shaft 40 is prevented. Splined shaft 40 is fixedly attached to and extends upstream of generally planar damper plate 42 which, as will be further discussed, has a formed peripheral seating surface 96. Fixedly attached to and extending downstream from damper plate 42 is a threaded spindle 44. Splined shaft 40, damper plate 42 and threaded spindle 44 comprise an essentially unitary damper assembly which, because of its splined portion, is prevented from rotating about its axis. Threaded spindle 44 of the damper assembly penetrates and is threadably engaged in drive gear 46.

Figure 5:
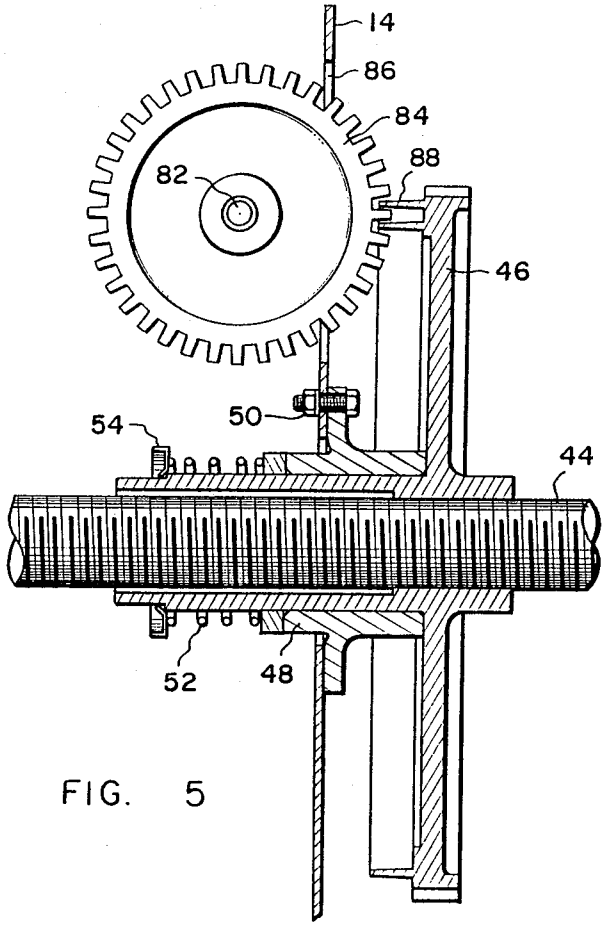
FIG. 5 is an enlarged cross-sectional view of a portion of the backplate and drive gear of the air valve of the present invention.

Referring additionally now to FIG. 5, it will be seen that drive gear 46 is mounted for rotation in a bushing 48 on backplate 14 of valve 10. Bushing 48 is fixedly attached to backplate 14 by screws 50. A spring 52 is trapped between a seating surface on bushing 48 and a spring clip 54. Spring clip 54 is attached to an extension of drive gear 46 which passes through and out of bushing 48 downstream of backplate 14. Spring 52 acts through clip 54 and drive gear 46 on threaded spindle 44 of the damper assembly to slightly pre-load/pre-tension the drive gear and damper assembly. The pre-tensioning of the drive gear and damper assembly prevents noise which might otherwise be associated with the chattering of the drive gear and damper assembly if it were not so loaded.

Also attached to backplate 14 is an electric drive motor 56 which has a pinion 58 machined into or attached to its drive shaft. Pinion 58 meshingly engages the teeth of drive gear 46 such that the drive gear is caused to rotate in accordance with the direction of rotation of pinion 58. The direction of rotation of pinion 58 is determined by the direction of rotation of the drive shaft of drive motor 56 which is a reversible motor. Power is supplied to motor 56 through a leads 60.

Support rods 18, which extend downstream of inlet section 12, are threaded at both of their ends. The upstream end of each support rod 18 is threaded into a cooperatively threaded hole 62 in inlet section 12 while the downstream threaded end of the support rods penetrate cooperatively spaced holes in backplate 14. Backplate 14 is trapped and fixedly mounted on rods 18 between nuts 64 and 66. Nuts 66 are preferably integrally formed on rods 18, as by cold forming, so as to ensure the uniformity of their location on the rods.

Mounted on backplate 14 is a strain sensing device 68 having leads 70 which, along with motor power leads 60, are connected to a controller 72 which is mounted on air distribution box 30. As will further be described, the abutment of damper plate 42 with seating surface 34, as motor 56 drives the valve closed, causes immediately detectable strain to develop in valve 10.

Motor 56 continues to run, immediately subsequent to the abutment of damper plate 42 with seating surface 34. Since damper plate 42 and damper assembly 16 are prevented from further upstream axial movement upon the abutment of damper plate 42 with seating surface 34, the continued rotation of spindle 44 under the impetus of motor 56 causes gear 46 to be driven away from inlet section 12 and into bushing 48 which is fixedly attached to backplate 14.

The force with which gear 46 is urged against bushing 48 creates strain in the valve which is sensed by device 68 as it increases. Because backplate 14 is fixedly mounted with respect to inlet section 12, the strain in the valve and in backplate 14 builds quickly and relatively sharply to a predetermined level, which is indicative of valve closure, subsequent to the abutment of damper plate 42 with seating surface 34. Device 68 produces an electrical signal corresponding to the level of strain in the valve. The signal is communicated from device 68 through leads 70 to controller 72.

Controller 72 responds to the strain signal received from device 68 by causing power to motor leads 60 to be interrupted when the predetermined level of strain indicative of valve closure is reached. It will be appreciated that the predetermined level of strain allowed to develop within the valve subsequent to its closure, although easily detected, is selected so as not to be large enough to cause concern with respect to the potential binding of valve components while assuring that the sealing abutment of the damper plate with the inlet section seating surface is accomplished. Motor 56 is therefore de-energized immediately subsequent to valve closure and well before its continued operation can cause excessive closing force, as indicated by elevated strain levels within valve 10, to develop.

Optionally, bumper elements 74 and 76 can be disposed on backplate 14 so that the movement of the damper plate away from inlet section 12 eventually brings the downstream face of damper plate 42 into contact with elements 74 and 76. It will be appreciated that such contact will likewise cause strain to be developed in valve 10 which, upon being sensed by device 68 can be employed to de-energize motor 56 subsequent to the completion of valve opening.

Alternatively, controller 72 may be of a type which causes motor 56 to de-energize, subsequent to the opening valve 10, based upon other factors or indications such as time of motor operation subsequent to being operated in the valve opening direction, the number of revolutions made by the motor or an associated rotating part or any one of a number of other features or functions of valve operation not necessarily related to the development of strain within the valve.

While the effectuation of a tight seal is necessary when damper plate 42 is driven into abutment with inlet section 12, which of necessity causes a degree of strain to develop within the valve, the exact position of damper plate 42, once it is sufficiently retracted from inlet section 12 to allow for maximum airflow through the valve, is not critical. Therefore, the employment of a strain sensing device to control the de-energization of motor 56 is of importance primarily as it relates to the closing of valve 10 to airflow.

It will be appreciated that the mounting of strain sensing device 68 on backplate 14, as illustrated in the drawing figures, represents the preferable and most convenient mounting location. Other locations include, but are not limited to, a surface of damper plate 42 as indicated by phantom strain sensing device 78 in FIGS. 3 and 4. Essentially, device 68 will preferrably be positioned at a location which is convenient from the manufacturing and operating standpoint and in which the sensing of strain in the valve upon valve closure can readily be sensed.

Figure 2:
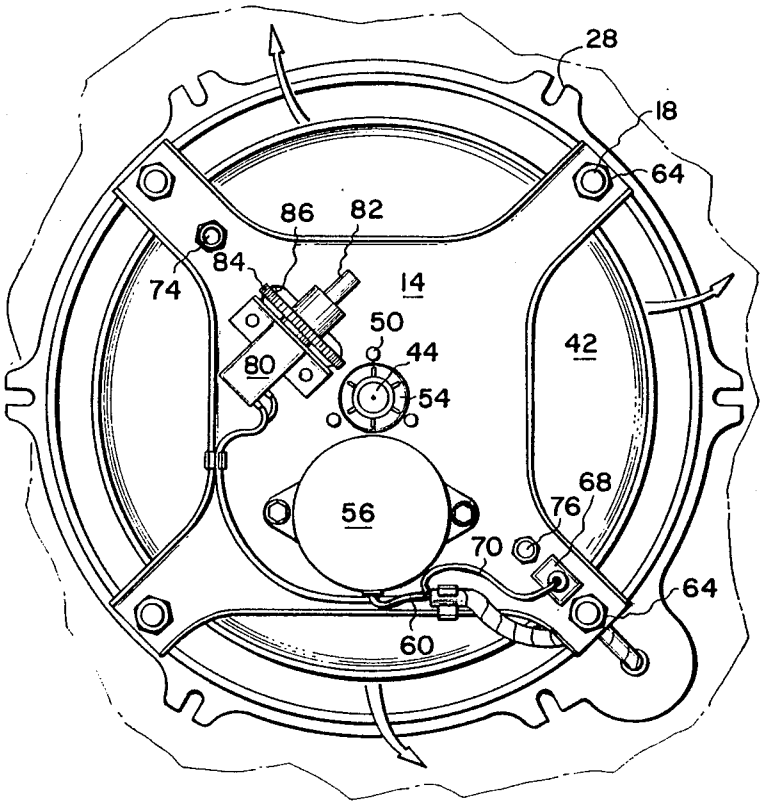
FIG. 2 is an end view of the air valve of the present invention from a position downstream of the valve.
Figure 6:
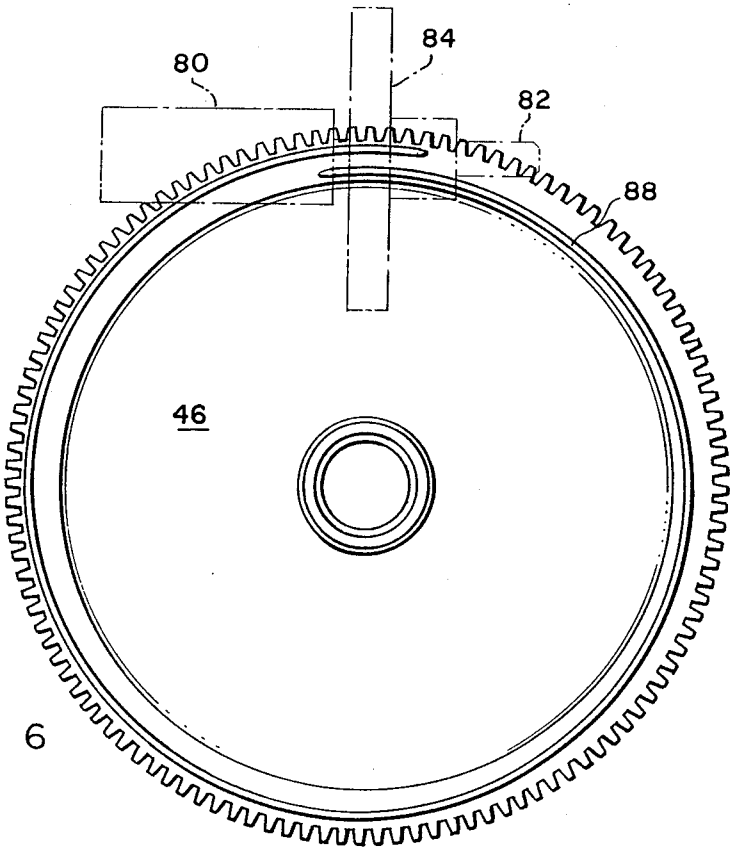
FIG. 6 is a view of the downstream face of the drive gear.

Valve 10 can additionally be provided with apparatus for providing an indication of the position of damper plate 42. One example of such apparatus includes a potentiometer 80 having a spindle 82 on which a gear 84 is mounted. Referring to FIGS. 2, 5 and 6 it will be seen that gear 84 protrudes through a slot 86 in backplate 14 and engages a spiral portion 88 that extends downstream of drive gear 46. As will further be discussed, the use of such apparatus represents still another method of controlling the de-energization of motor 56 subsequent to the opening of the valve to maximum airflow.

A flow sensing ring 90 is disposed in inlet section 12 and includes a series of apertures by which a static pressure is developed that indicates the volume of air flowing through valve 10. Flow sensor 90 is retained in place in inlet section 12 by a series of clips 94 which attach to support grid 20 found therein.

OPERATION

The position of damper plate 42 of damper assembly 16 of valve 10 is determinitive of the volume of air that flows into plenum 32 of the air distribution box 30. It will be appreciated that the volume of air flowing into plenum 32 is controllably varied by the selective positioning of damper plate 42 with respect to seating surface 34 of inlet section 12. As the demand for conditioned air in the space with which plenum 32 communicates decreases, motor 56 is controllably energized so as to drive pinion 58 in a direction which ultimately causes damper 42 to move toward seating surface 34 of inlet section 12.

It will be appreciated that when pinion 58 rotates in a first direction, drive gear 46 is caused to rotate, within bushing 48, in the opposite direction. The rotation of drive gear 46 in turn causes threaded spindle 44 to advance or retreat axially of the inlet section depending upon the direction of the threading of spindle 44 and its cooperating threaded portion in gear 46. It will be remembered that splined shaft 40 is captured in splined bushing 38 so that damper assembly 16 is incapable of rotating.

If the demand for conditioned air decreases sufficiently, motor 56 drives damper plate 42 toward the seating surface of inlet section 12 to the extent that formed seating surface 96 of the damper plate is urged into abutment with seating surface 34 of inlet section 12. Motor 56 continues to run immediately subsequent to the contact of damper plate 42 with seating surface 34.

In reaction to the prevention of damper plate 42 from continuing its upstream advance, due to its abutment with seating surface 34, detectable strain develops immediately in valve 10 which is sensed by device 68. Device 68 signals the development of such strain to controller 72 which interrupts the supply of power to motor 56. The interruption of power to motor 56 is accomplished before sufficient strain has developed in valve 10 to cause the potential mechanical binding of valve components and subsequent stalling of motor 56 at such time as controller 72 directs the valve to be opened by the reverse direction operation of motor 56. A tight seal between the damper plate 42 and inlet portion seating surface 34 is thereby achieved in a manner which is not susceptible to causing motor 56 to stall upon the closing of valve 10 to airflow.

When airflow is once again called for through valve 10, motor 56 is energized in a direction which causes pinion 58 and drive gear 46 to rotate so as to draw threaded spindle 44 through backplate 14 in a downstream direction. This, in turn, relieves the detectable strain which develops in the valve upon closing.

If maximum airflow is called for through valve 10, drive motor 56 causes the continued rotation of drive gear 46 in a direction which draws spindle 44, and therefore the entire damper assembly, away from the inlet section. Motor 56 continues to run and to draw the damper assembly in the downstream direction, if the demand for conditioned air is high enough to require it, until damper plate 42 is withdrawn from inlet section 12 to an extent which permits maximum airflow therethrough.

Because there are no abutment forces acting on the damper plate when in the full open position that correspond to the forces operating on the damper plate after it is driven into sealing abutment with the inlet section seating surface, there is no particular need for the employment of strain sensing apparatus to de-energize the motor when maximum airflow has been achieved. The use of strain sensing device 68 is, however, a viable option although it does require that detectable strain be caused to develop within the valve. Other methods of de-energizing motor 56 may be employed subsequent to the opening of the valve such as by determining the axial location of damper plate 42 within the valve by monitoring the number of rotations undergone by spindle 44 through the employment of potentiometer 80 and gear 84.

It will be appreciated, given the teachings herein, that many modifications might be made to the present invention which do not depart from the spirit of the invention. Therefore, the scope of the present invention is to be limited only in accordance with the language of the claims which follow.

What is claimed is:

1. An air valve comprising:

a generally cylindrical inlet section, said inlet section having a seating surface;

support means downstream of and fixedly mounted with respect to said inlet section;

a damper assembly, said damper assembly being restrained from rotation and being supported upstream of said seating surface by said inlet section and downstream of said seating surface by said support means;

means for driving said damper assembly into abutment with said inlet section seating surface, the abutment of said damper assembly with said seating surface causing strain to develop in said valve; and means for sensing the development of strain in said valve subsequent to the driving of said damper assembly into abutment with said inlet section seating surface, said means for sensing being operatively connected to said means for driving so that said means for driving is de-energized when the strain resulting from the abutment of said damper assembly with said inlet section seating surface reaches a predetermined level.

2. The air valve according to claim 1 wherein said means for sensing produces a signal indicative of the level of strain in said valve as said strain develops subsequent to the abutment of said damper assembly with said inlet section seating surface.

3. The air valve according to claim 2 wherein said means for driving includes a reversible electric motor mounted on said support means.

4. The air valve according to claim 3 wherein said means for driving includes means for controlling the energization and de-energization of said motor, said signal produced by said means for sensing being communicated to said means for controlling.

5. The air valve according to claim 4 wherein said means for sensing comprises a strain gauge mounted on said support means.

6. The air valve according to claim 4 wherein said means for sensing comprises a strain gauge mounted on said damper plate.

7. The air valve according to claim 5 wherein said support means includes a backplate and wherein said damper assembly includes a damper plate and a threaded spindle extending downstream thereof, said motor drivingly engaging said threaded spindle portion through a drive gear mounted for rotation on said backplate, said drive gear defining a threaded aperture which is threadably penetrated by said damper assembly spindle.

8. An air valve for a variable air volume air conditioning system comprising:

an inlet section defining a seating surface and a support grid upstream thereof;

a backplate fixedly attached to said inlet section;

damper means, including a damper plate, said damper means being restrained from rotation and being supported for movement within said valve by said backplate and said support grid, said damper plate being moveable between a first position in which said damper plate is retracted out of said inlet section and a second position in which said damper plate sealingly seats against said inlet section seating surface, the seating of said damper plate against said seating surface causing strain to develop in said valve;

an electric motor, said motor being drivingly engaged with said damper means;

means for controlling the energization and de-energization of said motor; and means, mounted on said valve, for sensing the strain which develops in said valve as a result of the seating of said damper plate against said seating surface, said strain sensing means communicating a signal to said means for controlling the energization and de-energization of said motor so as to cause the de-energization of said motor when the sensed seating strain reaches a level indicative of valve closure.

9. The air valve according to claim 8 wherein said means for sensing comprises a strain gauge.

10. The air valve according to claim 9 wherein said motor is a reversible motor and wherein said strain gauge is mounted on said backplate.

11. The air valve according to claim 10 wherein said damper means is restrained from rotation by spline means on said damper assembly and in said support grid.

12. The air valve according to claim 11 wherein said motor drivingly engages said damper assembly through a gear.

13. The valve according to claim 12 wherein said gear is mounted for rotation on said backplate, said gear defining an internally threaded aperture penetrated by a threaded spindle portion of said damper assembly, said threaded spindle portion penetrating said drive gear so that the rotation of said drive gear causes the axial movement of said damper assembly with respect to said inlet section seating surface.

14. The air valve according to claim 13 wherein said valve further comprises means for indicating the position of said damper plate with respect to said inlet section seating surface.

15. A method of operating an air valve through which air is supplied to an associated space where the air valve has a motor driven damper assembly, comprising the steps of:

supplying conditioned air to the valve;

positioning the damper assembly between an open position and a closed position so as to modulate the flow of conditioned air through the valve in response to the demand for conditioned air in the space with which the air valve is associated;

driving the damper assembly into abutment with a seating surface of the valve to close off the flow of air through the valve when conditions in the space dictate the closing of the valve, the abutment of the damper assembly with the seating surface causing strain to develop in the valve;

sensing the level of strain in the valve subsequent to said driving step; and interrupting power to the motor when the level of strain sensed in said sensing step exceeds a predetermined level.

* * * * *